US010056687B2

(12) United States Patent
Rojas Cuevas et al.

(10) Patent No.: US 10,056,687 B2
(45) Date of Patent: Aug. 21, 2018

(54) FLEXIBLE ELONGATED INDUCTOR AND ELONGATED AND FLEXIBLE LOW-FREQUENCY ANTENNA

(71) Applicant: PREMO, S.L., Camparillas (ES)

(72) Inventors: Antonio Rojas Cuevas, Málaga (ES); Francisco Ezequiel Navarro Perez, Bobadilla Estación Antequera (ES); Claudio Cañete Cabeza, Benalmadena (ES)

(73) Assignee: PREMO, S.L., Campanillas (ES)

( * ) Notice: Subject to any disclaimer, the term of this patent is extended or adjusted under 35 U.S.C. 154(b) by 0 days.

(21) Appl. No.: 15/448,212

(22) Filed: Mar. 2, 2017

(65) Prior Publication Data

US 2017/0256857 A1 Sep. 7, 2017

(30) Foreign Application Priority Data

Mar. 4, 2016 (EP) ..... 16380004

(51) Int. Cl.
*H01Q 7/08* (2006.01)
*H01Q 1/08* (2006.01)
(Continued)

(52) U.S. Cl.
CPC ..... *H01Q 7/08* (2013.01); *H01F 27/24* (2013.01); *H01F 27/28* (2013.01); *H01Q 1/085* (2013.01)

(58) Field of Classification Search
CPC ..... H01Q 7/08; H01Q 1/085
(Continued)

(56) References Cited

U.S. PATENT DOCUMENTS 3,743,727 A 7/1973 Herschler
6,147,665 A 11/2000 Friedman
(Continued)

FOREIGN PATENT DOCUMENTS

CN 85106221 2/1987
EP 0848577 6/1998
(Continued)

OTHER PUBLICATIONS

Bruce E. DePalma "The Generation of a Unidirectional Force" Simularity Institute Apr. 22, 1974.
(Continued)

*Primary Examiner* — Andrea Lindgren Baltzell

(57) ABSTRACT

The inductor comprises a winding arranged around a core formed by at least two rigid magnetic elements connected in an articulated manner forming an oblong assembly, each comprising: a head end A provided with a circular convex curved surface and a tail end B provided with a circular concave curved configuration, in relation to a transverse axis of the tail, parallel to the transverse axis of the head, and the configuration being complementary to said circular convex curved configuration. The head end A is coupled to the tail end B forming an articulated attachment, and the transverse axes of the head and tail coincide in the coupling area, providing a joint having a variable, adjustable angle, wherein the assembly of said two or more rigid magnetic cores is surrounded by a flexible polymer casing, including magnetic charges that work together to prevent magnetic flux dispersion in the coupling gaps or interstices between the magnetic cores.

17 Claims, 7 Drawing Sheets

(51) Int. Cl.
*H01F 27/28* (2006.01)
*H01F 27/24* (2006.01)

(58) Field of Classification Search
USPC ..... 343/788
See application file for complete search history.

(56) References Cited

U.S. PATENT DOCUMENTS

| | | | |
|---|---|---|---|
| 7,138,896 | B2 | 11/2006 | Berens et al. |
| 7,462,369 | B2 | 12/2008 | Smith |
| 9,184,506 | B2 | 11/2015 | Mobius et al. |
| 2002/0122011 | A1 | 9/2002 | Teshima |
| 2015/0123761 | A1 | 3/2015 | Winkler |
| 2015/0295315 | A1 | 10/2015 | Tanaka et al. |

FOREIGN PATENT DOCUMENTS

| | | |
|---|---|---|
| EP | 1723615 | 5/2014 |
| GB | 2025150 | 1/1980 |
| WO | 2009123432 | 10/2009 |
| WO | 2011120501 | 10/2011 |
| WO | 2013135381 | 9/2013 |
| WO | 2016038434 | 3/2016 |

OTHER PUBLICATIONS

European Search Report of priority application No. 16380004.8 dated Aug. 4, 2016.
Written Opinion of priority application No. 16380004.8 dated Aug. 4, 2016.

FLEXIBLE ELONGATED INDUCTOR AND ELONGATED AND FLEXIBLE LOW-FREQUENCY ANTENNA

RELATED APPLICATION

This application claims priority to European application number EP16380004.8, filed 4 Mar. 2016, the contents of which are hereby incorporated by reference as if set forth in their entirety.

TECHNICAL FIELD

The present invention is comprised in the field of keyless door opening or entry systems, of particular application in the automobile sector, in which they are also applied to controlling the electronic immobilizer for starting the engine. This "keyless" system (KES or Keyless Entry System or also referred to as PKE—Passive Keyless Entry) is based on the use of a remote control or device emitting wireless signals and on the arrangement in the vehicle itself of 3 or more antennas the function of which is to detect the presence (capturing the mentioned wireless signals), in a perimeter of about 1.5 m or more surrounding the vehicle, of the mentioned remote control device carried by a user. Based on said detection, the door is opened or locked and options of switching the engine on and off, comfort adjustments of the rearview mirrors, motorized seats, switching the courtesy light on, are also enabled among other possible functions.

The invention provides a keyless entry system with a single antenna.

To this end, the invention proposes the use of flexible elongated inductors which comprise a core formed by two or more rigid ferromagnetic cores or elements, connected in an articulated manner to one another at their ends, forming an oblong assembly capable of bending without risk on the integrity of the inductor, and having a coil made from a conductive element surrounding said composite core.

An elongated and flexible low-frequency antenna is easily obtained from the mentioned flexible inductor by providing electronic elements and eventually connection elements for connecting internally or externally to a capacitor to configure a resonant tank.

BACKGROUND

Engineers and technologist have been seeking for a keyless opening system with a single antenna for years. Many systems have been described in theory, but all of them lack the actual possibility of providing an antenna that overcomes the problem of fragile ferrite magnetic cores.

Keyless entry systems for the automotive industry often work at low frequencies, such as for example, at 20 KHz such as those described in MARQUARDT's patent documents EP-B1-1723615 and WO-A1-2013135381, or at 125 KHz and 134 KHz such as those described in CONTI's patent documents WO-A1-2011120501 or U.S. Pat. No. 9,184,506 B2.

In order to cover a minimum reading distance (capture the wireless signal of the remote control device) from the vehicle, the existing systems usually use short ferrite antennas arranged in the door handles and trunk. These antennas normally use cores made of soft ferrite magnetic material, ZnMn. Since ferrite is a brittle and fragile material, the maximum length of the antennas is limited to a length in which the ferrite can withstand a minimum torque or deformation. This limits the actual length of ferrite cores used to less than 180 mm and typically from 80 to 120 mm. These extremely fragile cores receive a coil which is protected by overmolding or by plastic casings and the antennas made of resulting wire coil are in general embedded in a resin or already overmolded with low pressure or by high pressure polymers.

All these plastic coatings and layers are intended for protecting the fragile ferrite core from external forces, torques, blows and bends.

PREMO's patent application PCT/IB2015/001238 describes flexible magnetic cores and processes for production thereof, based on microwires made from high-permeability soft magnetic alloys and polymer nanoparticles dispersed in a polymer matrix surrounding said microwires.

With continuous ferrite cores, the length of the antennas is limited and the systems of the state of the art describe arrangements with 3 to 5 antennas per vehicle in order to cover a minimum reading distance around the entire vehicle.

Meanwhile, the current antennas used in vehicles generally have a length less than 180 mm, the replacement thereof with a single antenna would require a length between 300 mm and 500 mm in order to generate a magnetic field having sufficient intensity to cover those generated by the current short antennas. However, an antenna so long cannot use a single solid ferrite core because in said case it would break easily with a very small bending force even if it is coated, molded or overmolded by means of a casing or surrounded by a hard plastic casing.

A possibility for solving the mentioned technical problem would be a "keyless" system that uses an elongated, completely flexible, low-frequency LF antenna, such as that provided in PREMO's patent application PCT/IB2015/001238.

This innovation would allow implementing a "KES" system that would provide, with a single antenna, performances equal to or greater than those provided by the systems of the state of the art with 3, 4 or 5 antennas. The innovation leads to a "KES" system having many technical and economical advantages:

- The wiring and connectors are reduced by ⅓, ⅕ or ¼, respectively.
- OEM assembly time is reduced by ⅓, ⅕ respectively.
- The total energy consumption and actual battery losses, a very important parameter particularly in electric vehicles, are proportionally reduced.
- A longer antenna requires lower currents to generate equal or more intense magnetic fields, thereby reducing the necessary energy and allowing reducing the cross section of the wire in the antennas' coil.

A reduction of the electrical output necessary in the vehicle is achieved with the foregoing; MOSFET transistors which allow reducing the number of amplifiers and the characteristics of the power stage by ⅓, ¼ or ⅕ and furthermore allow simplifying the final analog power elements necessary which may be simpler and less expensive due to the fact that a lower current is being used for generating the same magnetic fields than the systems of the art. In general, the Front-End or analog interface of the reader in the electronic control unit (ECU) is simplified both by reduction of the channels that would go from 5, 4 or 3 to 1 and by an important reduction of the power of the remaining channel.

The reliability of a vehicle is proportional to the number of components it incorporates so the mere reduction of the number of antennas and channels in the ECU provides intrinsic reliability increasing the mean time between system failures or MTBF.

Likewise, by using a single antenna the safety elements thereof are simplified.

An elongated inductor comprising multiple ferrite cores has been widely used for AM radio systems. Patent application WO-A2-2009123432 describes a solution consisting of multiple cores of cylindrical rods inside a coil. A more recent application in wireless charging systems was presented by Qualcom in patent application US-A1-2013249303 disclosing a plurality of aligned ferromagnetic elements.

SUMIDA's patent application US-A1-20150295315 describes rigid, solid ferrite cores that are introduced in a coil forming machine with a specific shape for arranging capacitors and waveguides.

Said PREMO's patent application PCT/1132015/001238 describes various materials other than ferrite such as nanocrystalline sheets but they have not been used in practice because said materials have a very significant drawback, the magnetostriction, a property of soft magnetic materials causing great changes in magnetic permeability under pressure or deformation. Therefore, while these sheet materials, although being very expensive, could theoretically be used in long antennas, in practice these antennas do not break, but change their permeability so much that the resonance frequency typical of the tuned tanks that they form in series or capacitors in parallel lack the minimum selectiveness required for a reliable system. On the other hand, the deformation of the sheets is only possible in the axis perpendicular to the wide side, while in the other two orthogonal axes the cores are non-deformable.

PREMO's patent application PCT/IB2015/001238 of PREMO provides an elongated antenna that can be bent in a three-dimensional space both along an X-axis and along an orthogonal Y-axis.

Another solution is described in SUMIDA's patent application US-A1-2015123761 based on a composite core made of a plurality of cylindrical ferrite cores (see FIG. 2) with a spherical concave or convex termination at the head and tail ends thereof, which are coupled to one another, and also discloses cores coupled to another in a book-like configuration (see FIG. 3).

The construction of elongated cores by means of adding longitudinally smaller elements coupled to one another is already disclosed in patent document US-A1-2015123761.

Other documents disclosing composite inductors include U.S. Pat. No. 6,417,665 B1 describing a long magnetometer with a flexible magnetic core, made up of several cores coupled to one another and EP-A2-0848577 describing the construction of a long and flexible magnetic core made of ferrite rods coupled at their ends. Furthermore, coupling at the ends of magnetic cores by means of physical interstices or separations between the spherical or cylindrical contacting surfaces (gap) is a common practice in magnetic rotating machines because they are required for assuring a constant and minimum gap, as well as for free movement. See, for example, the 1974 publication by Bruce De Palma "The generation of a unidirectional Force" (http//depalma.pair-.com/GenerationOfUnidirectionalForce.html).

In hard magnetic materials, it is also common practice for moving magnetic parts to use spherical interstices (gaps) in combination with ferrofluids for advanced bearings.

U.S. Pat. No. 7,138,896 describes ferrite cores made of individual elements coupled to one another in a head-tail-head manner by means of a cylindrical gap for EMI (electromagnetic interference) shielding in flat cables operating as an antenna radiating energy in the form of electromagnetic radiation.

The present invention prevents problems in the physical implementation of inductors with a plurality of magnetic cores coupled to one another and affecting their performance when they are applied for constructing an LF antenna for a KES system, as a result of the parasitic vertical and horizontal gaps, in particular:

- The discrete cylindrical elements or spherical core elements do not have an adhesive attachment at their contacting articulation ends, and there is no way to assure that the gap, which is demarcated by the distance of air or non-ferromagnetic material between core elements, does not become larger when an elongation occurs in direction X. Therefore, when an elongation occurs in direction X, the distance between the elements increases so the loss of magnetic flux increases, resulting in an increase in magnetic reluctance as a result of a lower permeability, causing a deviation of the resonance frequency and antenna malfunction.
- The discrete elements of the core that is cylindrical or having a rectangular cross section can slide with respect to one another, without any retention element between them, thereby causing a horizontal separation generating a misalignment of the magnetic cores coupled to one another increasing the total reluctance in the manner proportional to the number of elements. This horizontal separation or interstice reduces the constant cross section area available intersected by the lines of magnetic field, thereby resulting in a reduction of the effective permeability. On the other hand, the magnetic leakage flux lost in the gap is not redirected by a low reluctance magnetic path, losing the induction capacity in the coil.

Both effects, i.e., misalignment in the direction of the Y-axis and the enlargement of the gap in the direction of the X-axis of a three-dimensional space determine an inefficient performance of the mentioned composite inductors.

The present invention proposes a solution to the mentioned problems and allows constructing a flexible antenna having a length greater than 300 mm.

BRIEF DESCRIPTION OF THE INVENTION

The invention provides a flexible elongated inductor, comprising a coil made from a conductive element (metal wire or conductive foil) arranged around a core formed by two or more rigid magnetic elements or magnetic cores, made from ferromagnetic material, connected in an articulated manner to one another at their ends, forming an oblong assembly such as that described, for example, in U.S. Pat. No. 7,138,896, wherein each of the magnetic cores comprises:

- a head end A provided with a circular convex curved surface in relation to a transverse axis of the head;
- a tail end B provided with a circular concave curved configuration in relation to a transverse axis of the tail, parallel to the transverse axis of the head, and being said circular concave curved configuration complementary to said circular convex curved configuration, The magnetic cores are coupled such that the head end A of a magnetic core is coupled, through contact surfaces, to the tail end B of an adjacent magnetic core, forming an articulated attachment and the mentioned transverse axes of the head and tail of the two magnetic cores coupled to one another coinciding in the coupling area, providing a joint having a variable, adjustable angle, like links of a flat chain.

According to the proposal of this invention, the mentioned assembly of said two or more rigid magnetic cores is surrounded by a flexible polymer casing, including magnetic charges that work together to prevent magnetic flux dispersion in the coupling areas or interstices (gaps) between said magnetic cores, the mentioned flexible polymer casing including microfibers, microparticles and/or nanoparticles of a soft ferromagnetic material present alone or in any combination thereof inside the polymer matrix of said polymer casing.

The present invention describes a keyless opening system for automobiles based on a single, elongated and flexible or semi-flexible LF antenna (primarily from 20 KHz to 300 Khz).

In one embodiment, the mentioned microfibers, microparticles and/or nanoparticles of a soft ferromagnetic material represent about at least 50% of the total weight of the polymer casing.

Furthermore, the mentioned articulated attachment includes at least one transverse retention configuration formed by a projection and a recess complementary to one another, defined in said head end A and tail end B, respectively, and formed from said ferromagnetic material of the mentioned magnetic cores, preventing said retention configuration from being misaligned in a transverse direction of the magnetic cores coupled to one another.

According to a preferred embodiment of the invention, each of the magnetic cores connected in an articulated manner has a rectangular cross section and more specifically a rectangular prismatic configuration, said retention projection and recess being defined on respective opposing, smaller rectangular faces of both ends A and B of the magnetic core.

By means of such coupling arrangement between the magnetic cores, a flexible elongated inductor having a length greater than 15 cm and preferably greater than 30 cm and with a maximum length of about 60 cm (sufficient length for the applications of a KES system, as described, although greater inductor lengths would be perfectly attainable, operating perfectly and with minimum magnetic flux losses.

The invention also proposes an elongated flexible antenna formed by a flexible inductor constructed according to the preceding specifications around which a wire coil or metal conductive cable (or a conductive foil) is extended.

Other features of the invention are described in the following detailed description of an embodiment.

BRIEF DESCRIPTION OF THE DRAWINGS

The foregoing and other advantages and features will be better understood based on the following detailed description of an embodiment in reference to the attached drawings which must be interpreted in an illustrative and non-limiting manner, in which:

FIGS. 2A and 2B show two embodiments for a magnetic core according to the invention which are equivalent to those illustrated in FIGS. 1A and 1B, although the arrangement of the projection and recess is the other way round.

DETAILED DESCRIPTION OF SEVERAL EMBODIMENTS

As shown in the different embodiments of FIGS. 1A to 5C, the invention relates to a flexible elongated inductor formed by a plurality of rigid magnetic cores 10, 11, made from ferromagnetic material, connected in an articulated manner to one another at their ends, forming an oblong assembly, already known in the state of the art, as referred to therein and wherein each of the magnetic cores 10, 11 comprises:

- a head end A provided with a circular convex curved surface in relation to a transverse axis of the head; and
- a tail end B provided with a circular concave curved configuration, in relation to a transverse axis of the tail, parallel to the transverse axis of the head, and being said circular concave curved configuration complementary to said circular convex curved configuration.

Figure 1A:
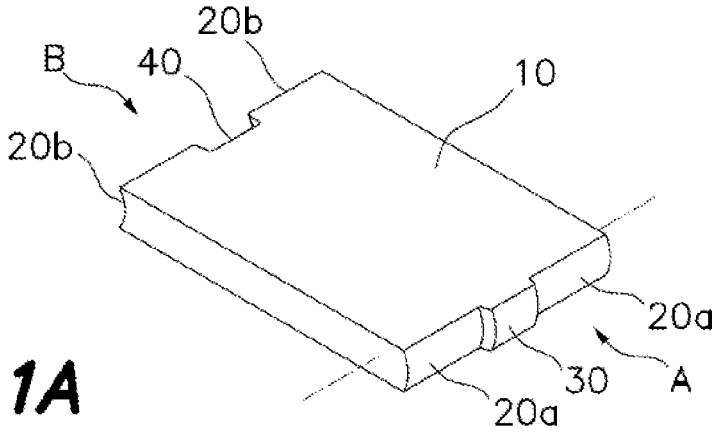
FIG. 1A shows a first embodiment of a magnetic core according to the invention and FIG. 2A shows a second embodiment that differ in the arrangement of the retention recess or projection and of the corresponding contact coupling surfaces for linking with other inductors to form a flexible elongated inductor, as described above.
Figure 1B:
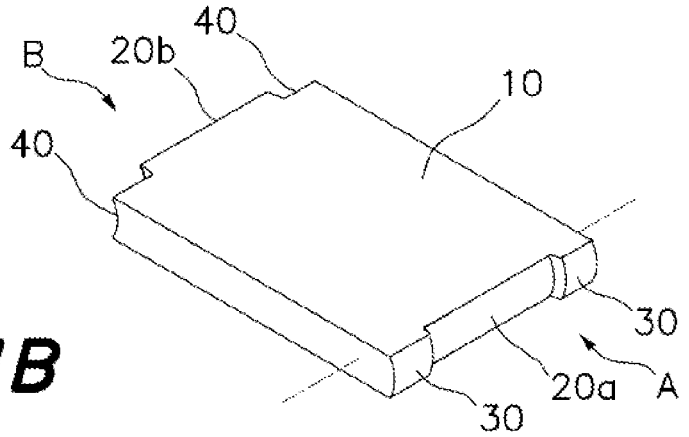
FIG. 1C shows detailed section view of the coupling between the cores corresponding to the embodiment of FIG. 1A.
Figure 1C:
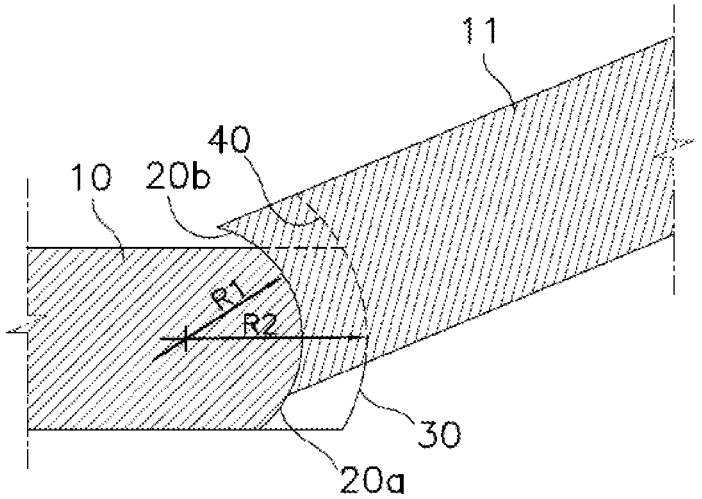
Figure 2A:
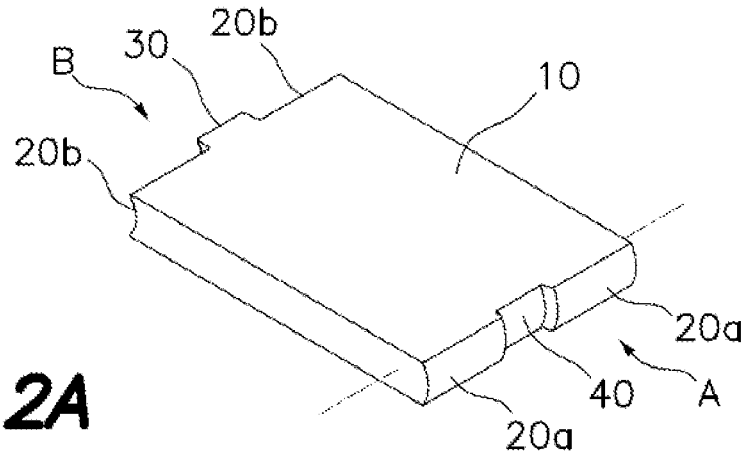
Figure 2B:
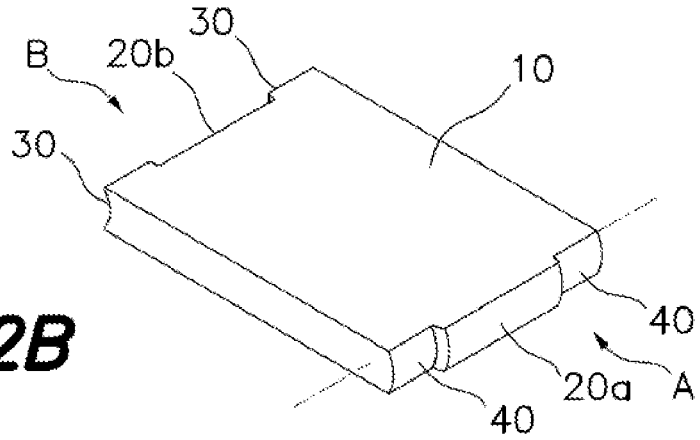
Figure 2C:
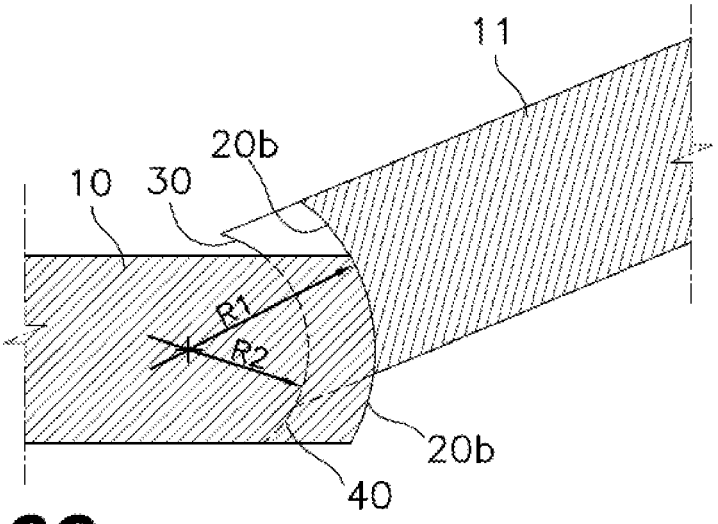
FIG. 2C shows the section view of the coupling between two magnetic cores according to FIG. 2B.
Figure 3A:
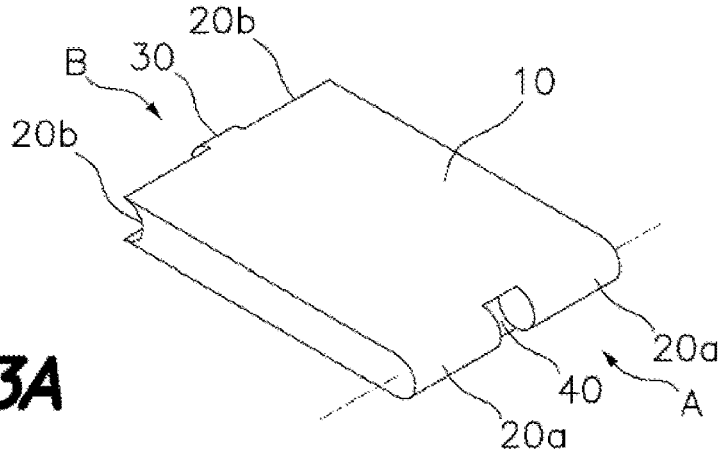
FIGS. 3A and 3B show two other possible embodiments of magnetic cores having the features of the invention.
Figure 3B:
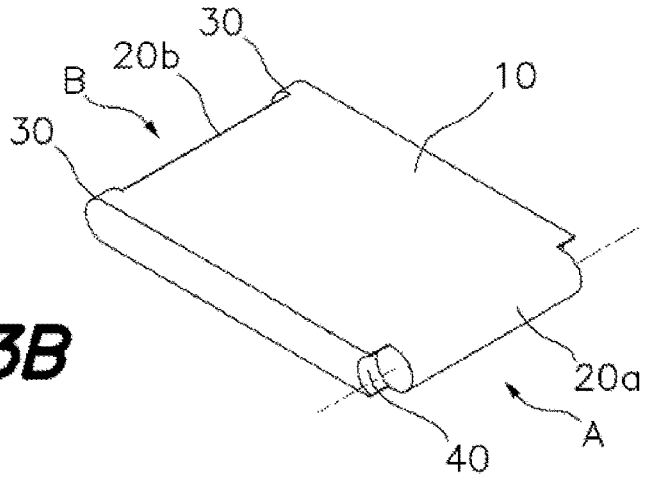
Figure 3C:
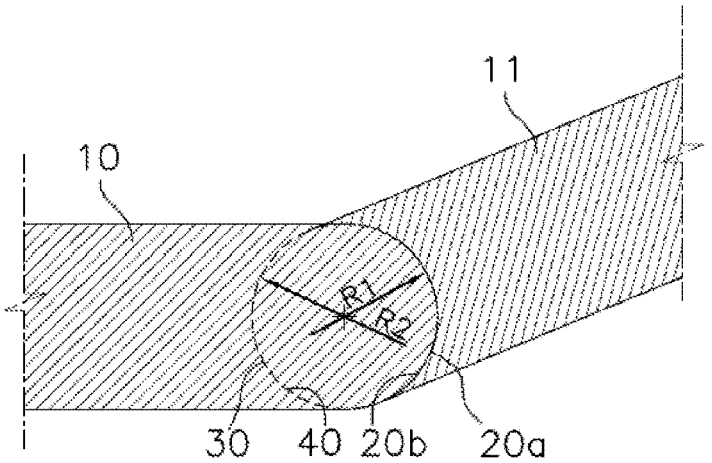
FIG. 3C is a section view of a coupling between the cores having a configuration according to FIG. 3B.
Figure 4A:
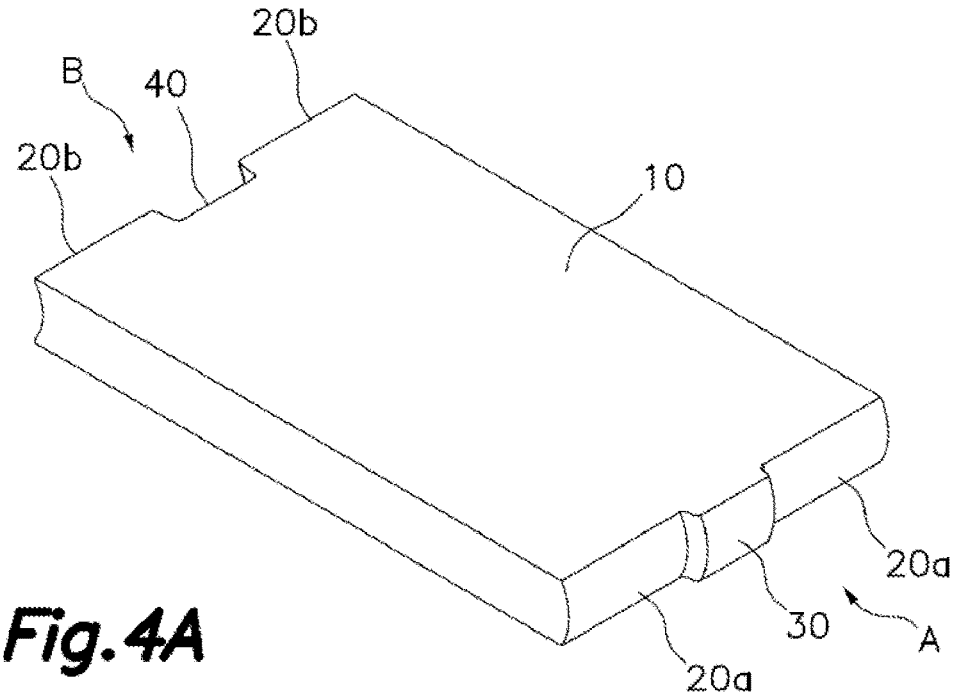
FIGS. 4A and 4B show another embodiment of magnetic core according to the principles of the invention and FIG. 4C illustrates the element sectioned through the plane of section illustrated in FIG. 4B.
Figure 4B:
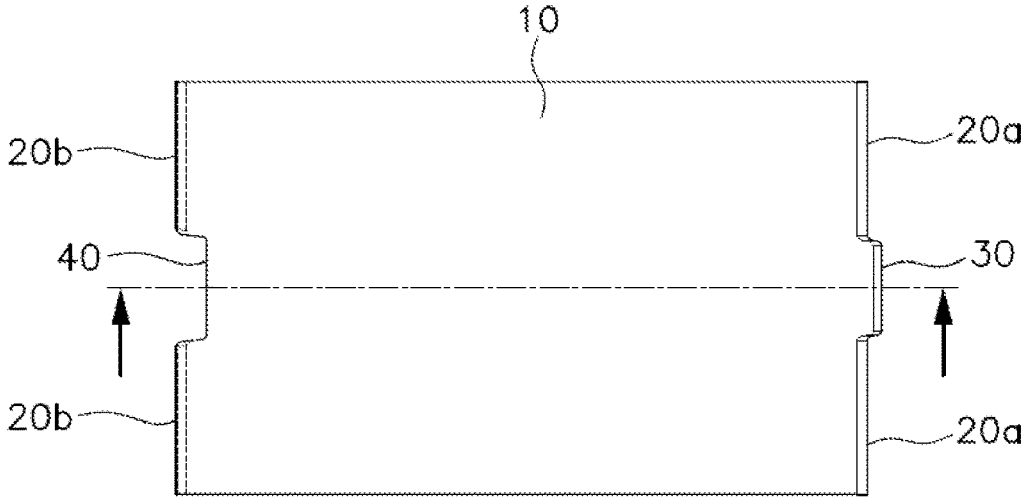
Figure 4C:
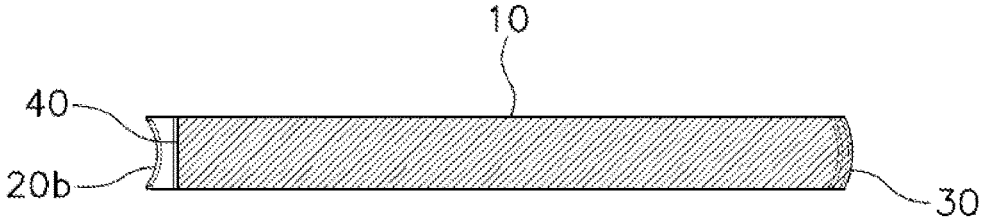
Figure 5A:
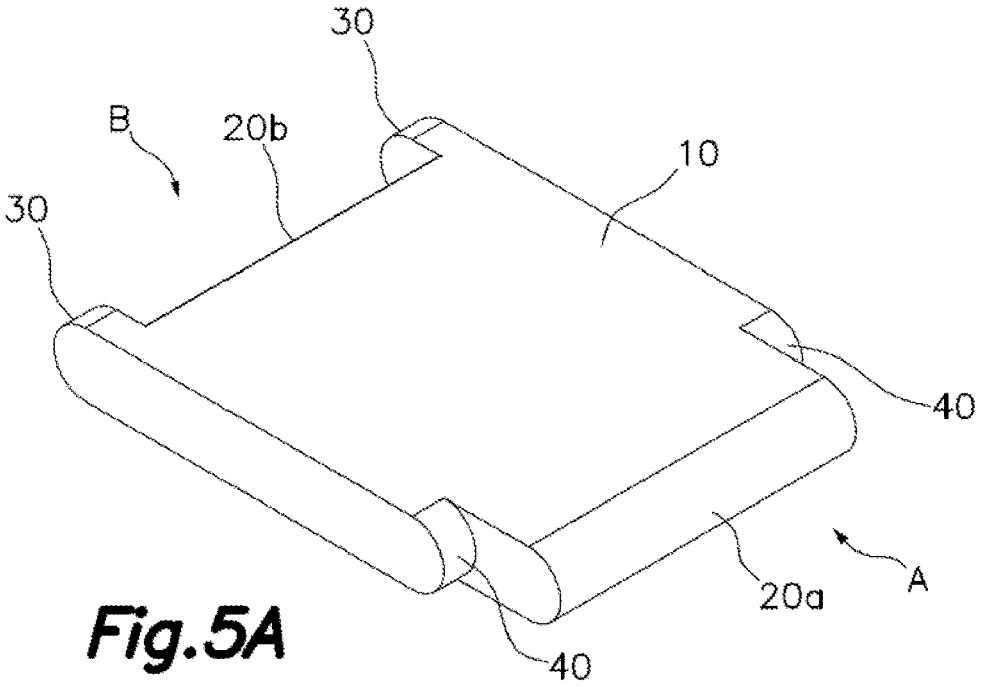
FIGS. 5A and 5B are yet other embodiments of magnetic cores according to the invention, FIG. 5C illustrating a cross section of the said magnetic core according to the plane of section indicated in FIG. 5B.
Figure 5B:
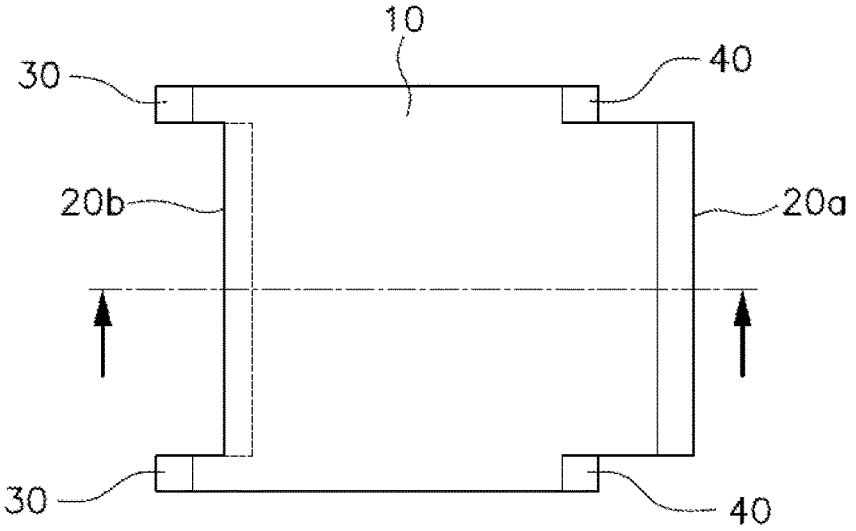
Figure 5C:
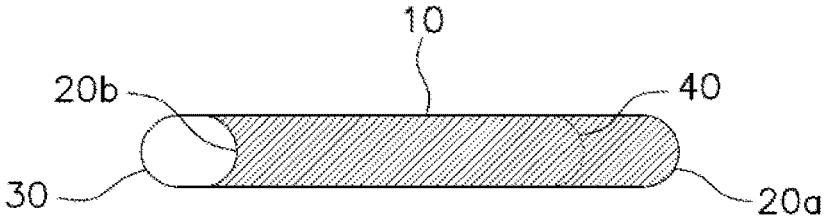
Figure 6A:
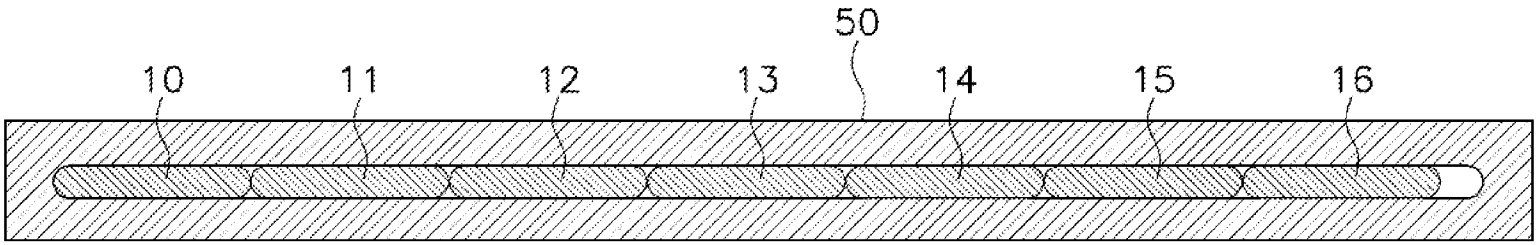
FIGS. 6A and 6B indicate an example of an elongated magnetic inductor formed by the coupling of seven magnetic cores, the assembly being surrounded by a flexible polymer casing, including magnetic charges that work together to prevent magnetic flux dispersion in the coupling areas or interstices (gaps) between said magnetic cores. An elongated flexible antenna will be obtained from the flexible inductor of said FIGS. 6A and 6B, a conductive wire or a conductive sheet suitably coiled around the body thereof.
Figure 6B:
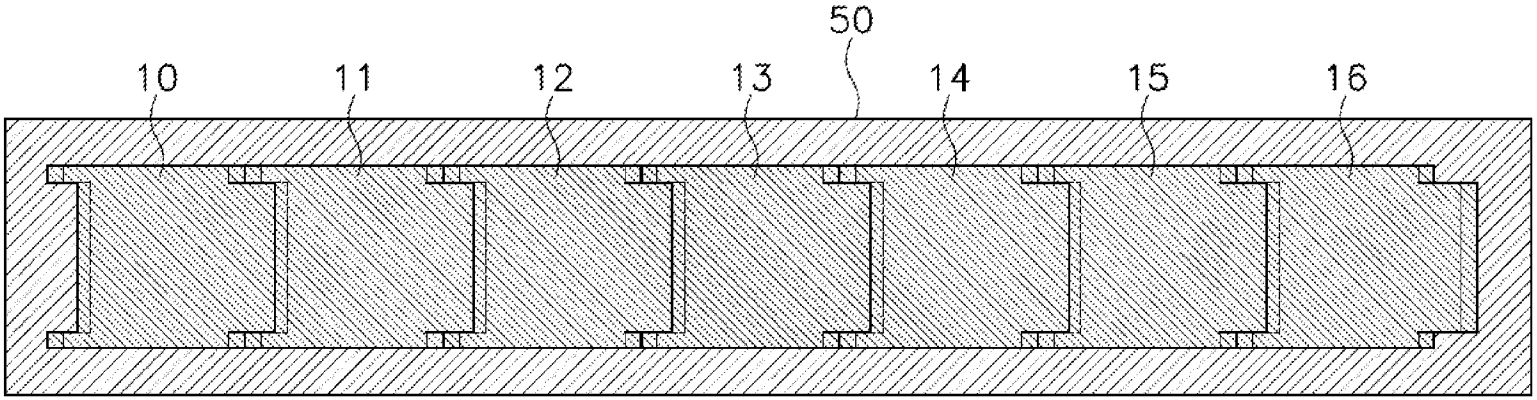

Said articulated connection or coupling between the magnetic cores is performed such that the head end A of a magnetic core is coupled, through contact surfaces 20*a*, 20*b*, to the tail end B of an adjacent magnetic core, forming an articulated attachment around the mentioned transverse axis and the transverse axes of the head and tail of the two magnetic cores coupled to one another 10, 11 coinciding in the coupling area (see, in particular, drawings in section view) providing a joint having a variable, adjustable angle, As clearly illustrated in FIGS. 6A and 6B, the invention is characterized in that the assembly of said rigid magnetic cores 11, 12, 13, 14, 15, 16 (six in this embodiment) is surrounded by a flexible polymer casing 50 including magnetic charges that work together to prevent magnetic flux dispersion in the coupling areas or interstices (gaps) between said plurality of magnetic cores 10, 11 coupled to one another.

As indicated, the mentioned flexible polymer casing includes in a preferred embodiment microfibers, microparticles and/or nanoparticles of a soft ferromagnetic material present alone or in any combination thereof inside the polymer matrix of said polymer casing. Likewise, the mentioned microfibers, microparticles and/or nanoparticles of a soft ferromagnetic material can represent about at least 50% of the total weight of the core. Such casing assures that there are no magnetic flux losses in the joint areas or contact surfaces 20*a*, 20*b* of the magnetic cores.

The mentioned drawings illustrate preferred embodiments wherein each of the magnetic cores 10, 11, 12, 13, 14, 15, 16 coupled to one another or connected in an articulated manner has a rectangular cross section, such that they form a flat, flexible elongated inductor.

A second relevant feature of the invention lies in the fact that said articulated attachment of the magnetic cores 10, 11 includes at least one transverse retention configuration formed by a projection 30 and a recess 40 complementary to one another, defined in said head end A and tail end B, respectively, and formed from said ferromagnetic material of the mentioned magnetic cores, preventing said retention configuration from being misaligned in a transverse direction of the magnetic cores 10, 11 coupled to one another.

The features relating to the explained setting-up and arrangement of the coupling between the magnetic cores allow obtaining a flexible elongated inductor with a length greater than 15 cm and preferably greater than 30 cm.

To use the flexible elongated inductor as an antenna (with a coil around its elongated section), it is considered that a maximum length of about 60 cm is sufficient, although the principles of the invention must not be understood as being limited to said maximum value, considered as sufficient for the desired functionality and performances in the automobile field.

The proposed magnetic core has a rectangular prismatic configuration, said projection 30 and recess 40 being defined on respective opposing, smaller rectangular faces of both ends A and B of the magnetic core 10, 11. In the different embodiments, the differences lies in where said projection 30 and recess 40 and the corresponding contact surfaces 20*a* and 20*b* between the different magnetic cores have been configured.

Particularly, solutions have been shown wherein the projection 30 and the recess 40, in retention and anti-sliding functions, adopt a central position in relation to the assembly of rigid magnetic cores 10, 11 coupled to one another at their ends A and B, whereas in other examples said projection 30 and said recess 40 adopt a side position in relation to the assembly of rigid magnetic cores 10, 11 coupled to one another at their ends A and B.

In embodiments suitable for the described functionality, it has been envisaged that said projection 30 and said recess 40 have a span with a width of 10% in relation to the largest width of the rectangular prismatic body, or a width of a 60% in relation to the largest width of the rectangular prismatic body.

In the embodiment of FIGS. 6*a* and 6*b*, the inductor includes seven magnetic cores coupled to one another and a total extension determining that, when held by one end, the free end will bend a maximum of 2 cm for a length of 30 cm.

As indicated, a flexible LF antenna will be obtained by means of a suitable coil of a conductive metal wire 51 (or alternatively of a conductive foil) arranged around an elongated flexible inductor such as those described.

Figure 7:
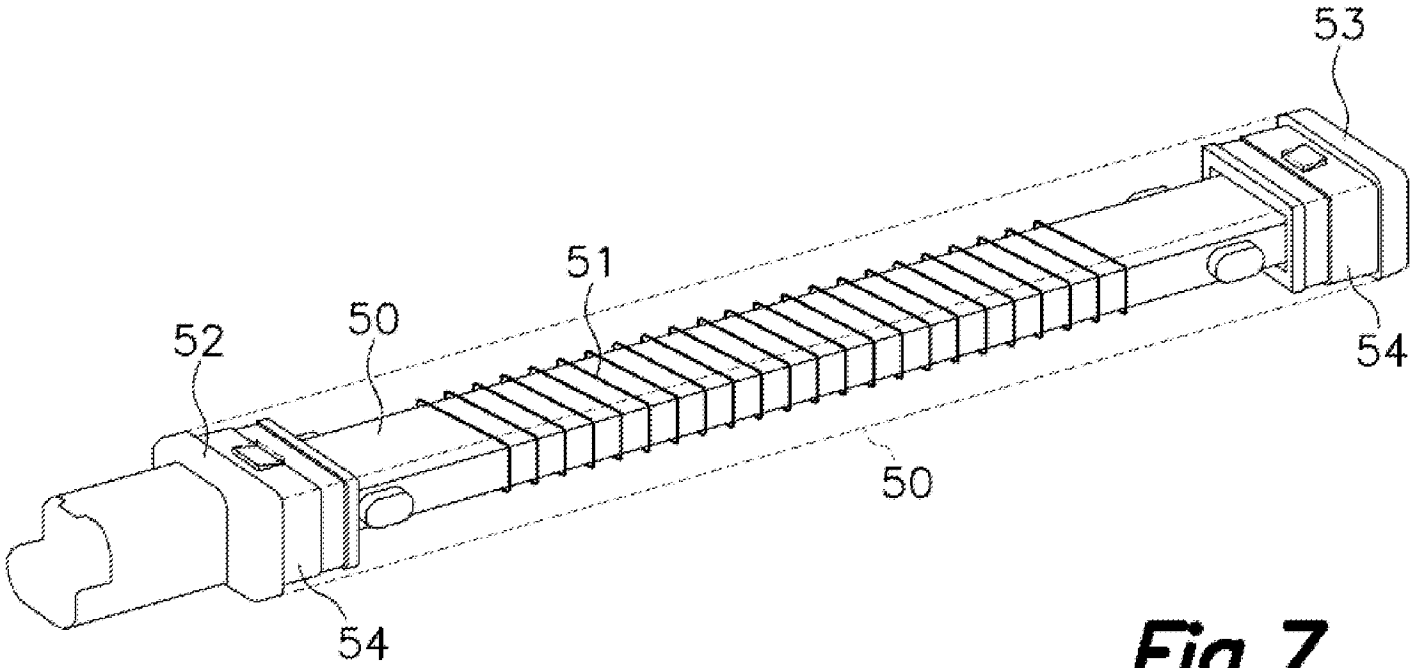
FIG. 7 shows a perspective view of a possible embodiment of such LF antenna.

FIG. 7 depicts a possible embodiment of an LF antenna using the proposed flexible inductor in which there can be seen the polymer casing 50 and the coil 51 forming the mentioned flexible inductor, boxes made, for example, of a PBT thermoplastic polymer, front part 52 integrating a connector and terminals and rear part 53 and closure gaskets 54, said boxes 52, 53 being attached through a tube 55 likewise made of a PBT plastic, providing a suitable flexibility.

The invention claimed is:

1. A flexible elongated inductor comprising a winding made from a conductive element arranged around a core formed by at least two rigid magnetic cores, made from ferromagnetic material, connected in an articulated manner to one another at their ends, forming an oblong assembly, wherein each of the at least two magnetic cores comprises:

a head end A, provided with a circular convex curved surface in relation to a transverse axis of the head; and a tail end B, provided with a circular concave curved configuration in relation to a transverse axis of the tail, parallel to the transverse axis of the head, said circular concave curved configuration being complementary to said circular convex curved configuration, wherein the head end A of one of said magnetic cores is coupled through contact surfaces with the tail end B of an adjacent magnetic core, forming an articulated attachment, wherein said transverse axes of the head and tail of the at least two magnetic cores are coupled to one another coinciding in the coupling area, providing a joint having a variable, adjustable angle, and wherein the oblong assembly of said two or more rigid magnetic cores is surrounded by a flexible polymer casing, including magnetic charges that work together to prevent magnetic flux dispersion in the coupling areas or interstices between said at least two magnetic cores, said flexible polymer casing including microfibers, microparticles and/or nanoparticles of a soft ferromagnetic material present alone or in any combination thereof inside the polymer matrix of said polymer casing, providing said magnetic charges.

2. The flexible elongated inductor according to claim 1, wherein each of the magnetic cores connected in an articulated manner has a rectangular cross section.

3. The flexible elongated inductor according to claim 1, wherein said articulated attachment includes at least one transverse retention configuration formed by a projection and a recess complementary to one another, defined in said head end A and tail end B, respectively, and formed from said ferromagnetic material of the mentioned magnetic cores, preventing said retention configuration from being misaligned in a transverse direction of the magnetic cores coupled to one another.

4. The flexible elongated inductor according to claim 2, wherein said articulated attachment includes at least one transverse retention configuration formed by a projection and a recess complementary to one another, defined in said head end A and tail end B, respectively, and formed from said ferromagnetic material of the mentioned magnetic cores, preventing said retention configuration from being misaligned in a transverse direction of the magnetic cores coupled to one another.

5. The flexible elongated inductor according to claim 1, wherein the flexible elongated inductor has a length greater than 15 cm.

6. The flexible elongated inductor according to claim 5, wherein the flexible elongated inductor has a maximum length of about 60 cm.

7. The flexible elongated inductor according to claim 3, wherein the flexible elongated inductor has a length greater than 15 cm.

8. The flexible elongated inductor according to claim 7, wherein the flexible elongated inductor has a maximum length of about 60 cm.

9. The flexible elongated inductor according to claim 1, wherein said microfibers, microparticles and/or nanoparticles of a soft ferromagnetic material represent about at least 50% of the total weight of the core.

10. The flexible elongated inductor according to claim 4, wherein said magnetic core has a rectangular prismatic configuration, said projection and recess being defined on respective opposing, smaller rectangular faces of both ends A and B of the magnetic core.

11. The flexible elongated inductor according to claim 10, wherein said projection and said recess adopt a central position in relation to the assembly of rigid magnetic cores coupled to one another at their ends A and B.

12. The flexible elongated inductor according to claim 10, wherein said projection and said recess adopt a side position in relation to the assembly of rigid magnetic cores coupled to one another at their ends A and B.

13. The flexible elongated inductor according to claim 11, wherein said projection and said recess have a width being 10% of a largest width of the rectangular prismatic body, or have a width being 60% of the largest width of the rectangular prismatic body.

14. The flexible elongated inductor according to claim 1, wherein the inductor has at least 5 magnetic cores coupled to one another and a total extension providing a sag of 2 cm for a length of 30 cm.

15. An elongated flexible antenna formed by a flexible inductor according to claim 1.

16. The elongated flexible antenna according to claim 15, wherein the winding made from a conductive element comprises a conductive wire or a conductive foil.

17. The elongated flexible antenna according to claim 16, wherein said antenna is an LF antenna operating in a range of frequencies of 20 KHz to 300 Khz.

* * * * *